United States Patent [19]

Bennett

[11] Patent Number: 4,669,622

[45] Date of Patent: Jun. 2, 1987

[54] PLASTIC ENCLOSURE FOR CONTAINER EMPLOYING THREE LIVING HINGES

[75] Inventor: Robert A. Bennett, Easton, Conn.

[73] Assignee: Anchor Hocking Corporation, Lancaster, Ohio

[21] Appl. No.: 847,258

[22] Filed: Apr. 2, 1986

[51] Int. Cl.[4] ..... B65D 51/00

[52] U.S. Cl. ..... 215/237; 220/335; 222/498; 222/517; 222/556

[58] Field of Search ..... 215/237, 235; 220/335; 222/498, 517, 556

[56] References Cited

U.S. PATENT DOCUMENTS

| | | | |
|---|---|---|---|
| 4,158,902 | 6/1979 | Chernack et al. | 222/498 X |
| 4,358,032 | 11/1982 | Libit | 222/556 X |
| 4,503,991 | 3/1985 | Joyce | 215/237 X |

*Primary Examiner*—Donald F. Norton

*Attorney, Agent, or Firm*—Stoll, Wilkie, Previto & Hoffman

[57] ABSTRACT

A hollow vertical cylinder is open at its lower end. A deck having an open communicating with the interior of the cylinder seals the upper end of the cylinder. A cap for the upper end has essentially the same shape and size as the top end. The cap has a first relatively small section and a second relatively large section. The first section is secured along a portion of its periphery to a corresponding portion of the upper end periphery by an integral living hinge. The two sections have adjacent edges disposed along a curved line which extends across the deck, these edges being secured to each other at opposite ends of the line and being otherwise unsecured to each other. The secured edges at each end of the line each constitute a separate integral living hinge. The first section is secured to the top end in a region spaced from both hinges. A prong is secured to the second section and is insertable into and removable out of the opening in the deck.

4 Claims, 9 Drawing Figures

FIG. 1
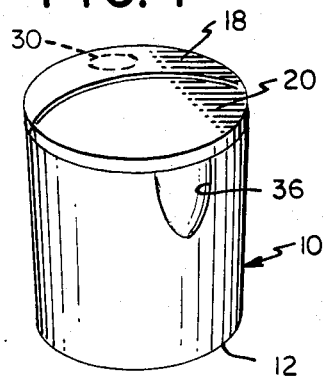
FIG. 3
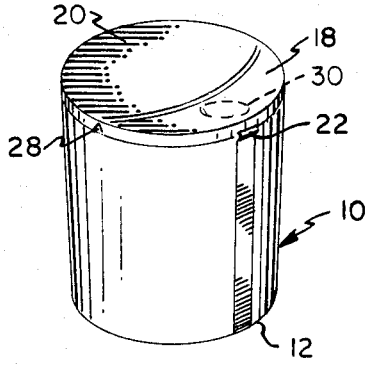
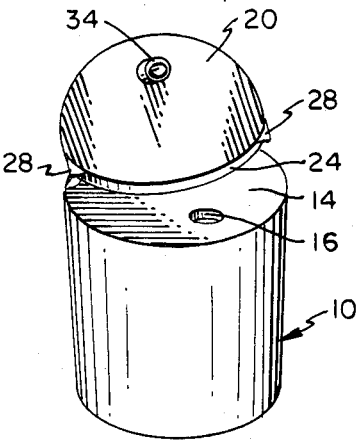
FIG. 2
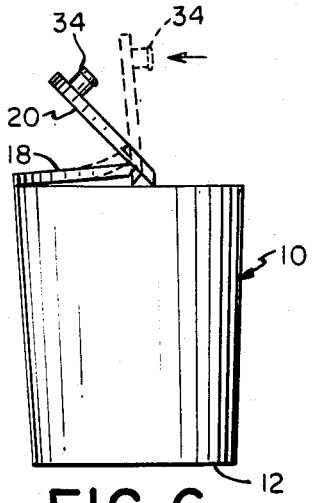
FIG. 6
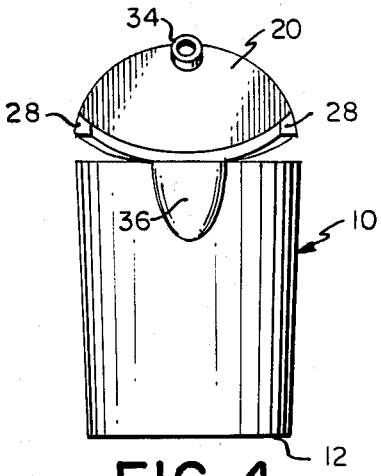
FIG. 4
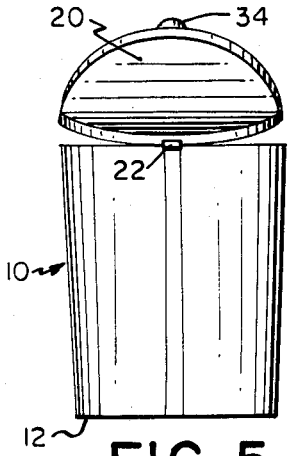
FIG. 5
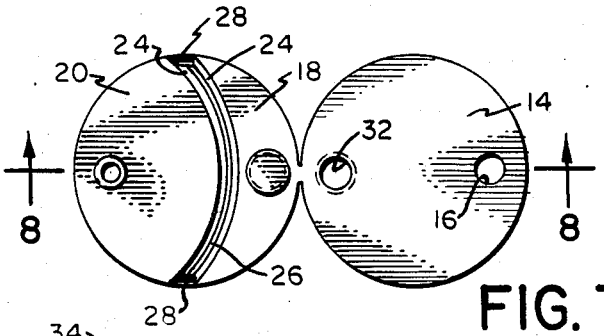
FIG. 7
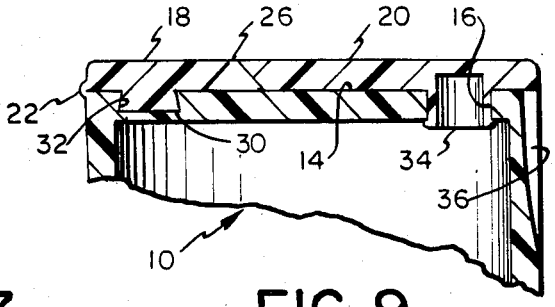
FIG. 9
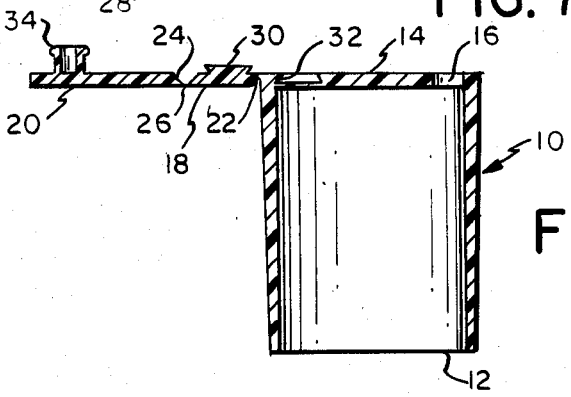
FIG. 8

PLASTIC ENCLOSURE FOR CONTAINER EMPLOYING THREE LIVING HINGES

BACKGROUND OF THE INVENTION

U.S. Pat. No. 4,487,324 discloses a plastic enclosure employing a vertical hollow cylinder open at its lower end. The cylinder is snap fitted onto the open neck of a plastic container. A deck with an opening communicating with the open neck closes the upper end of the container. A cap having a sealing stud movable into and out of sealing engagement with the deck is connected to the cylinder by upper hinges as well as by a hinge assembly strap which is hinged to the cap and also hinged to the cylinder. When the enclosure is closed, the cap rests on top of the deck. When the enclosure is opened, the cap must be swung away from the cylinder to expose the entire deck.

The present invention is directed to a new type of plastic enclosure which utilizes fewer hinge connections and which has a cap which can be opened and closed with a snap action that only exposes a portion of the deck.

SUMMARY OF THE INVENTION

In accordance with the principles of this invention, a plastic device is adapted to engage and close the open neck of a container. The device employs a vertical hollow cylinder open at its lower end. A deck seals the upper end of the cylinder and has an opening communicating with the interior of the cylinder.

The device also has a cap which has essentially the same shape and area as the upper end, the cap consisting of a first relatively small section and a second relatively large section. The first section is secured along a portion of its periphery to a corresponding portion of the periphery of the top end by a first integral living hinge. The two sections have adjacent edges disposed along a curved line which extends across the deck, these edges being secured to each other at opposite ends of the line and being otherwise unsecured to each other. The secured edges at each end of the line each constitute a separate integral living hinge, whereby a total of three living hinges are employed.

Interconnecting means on the deck and the first section, spaced from all the living hinges, secure the first section to the deck. A prong is secured to the second section and extends at right angles thereto.

In use, the cylinder is secured to the open neck of a container. When the device is closed, both cap sections overlie the deck with the prong sealing the opening. In order to open the device, a peripheral edge of the second section, disposed opposite to the first hinge is forced upward, thus causing the first section to pivot about the two end hinges as the angle of pivot is increased beyond ninety degrees, the second hinge initiates a snap action which causes the second section to pivot further into an open position overlying the first section. This action moves the prong out of engagement with the opening in the deck and exposes the opening so that the contents of the container can be poured out.

BRIEF DESCRIPTION OF THE DRAWINGS

FIG. 1 is a perspective front view of one embodiment of the invention, showing the device in closed position.

FIG. 2 is a view similar to FIG. 1, showing the device in open position.

FIG. 3 is a rear perspective view of the embodiment shown in FIG. 1.

FIG. 4 is a front view of the structure shown in FIG. 2.

FIG. 5 is a rear view of the structure shown in FIG. 2.

FIG. 6 is a side view of the structure shown in FIG. 1, illustrating the snap action.

FIG. 7 is a top view of the device prior to the engagement of the first section and the deck.

FIG. 8 is a view taken along line 8—8 in FIG. 7.

FIG. 9 is a view similar to FIG. 8 but showing the device in closed position.

DETAILED DESCRIPTION OF PREFERRED EMBODIMENTS

Referring now to FIGS. 1–9, the plastic device includes a vertical hollow cylinder 10 having an open lower end 12. A flat deck 14 seals the upper end of the cylinder and has opening 16 therein which communicates with the interior of the cylinder. A cap having essentially the same shape and size as the top end consists of a first relatively small section 18 and a second relatively large section 20. Section 18 has an exposed periphery coincident with a portion of the periphery of the upper end of the cylinder. Section 18 is secured along a portion of its periphery to a corresponding portion of the periphery of the upper end by an integral living hinge 22. Sections 18 and 20 have adjacent edges 24 disposed along a curved line 26. These adjacent edges are secured to each other at opposite ends of the line and constitute separate integral living hinges 28. These edges are otherwise unsecured to each other.

Section 18 has an extension 30 which snap fits into an undercut recess 32 after hinge 22 has been folded over whereby section 18 is permanently locked to the deck and rests on the deck at all times. Section 20 has prong 34 which extends at right angles thereto and can be inserted into sealing engagement with opening 16 when the device is closed and can be swung out of engagement when the device is opened.

The opening and closing actions are illustrated in FIG. 6. To open, the user places his finger in finger receiving recess 36 and presses upwardly upon the adjacent peripheral edge of section 20. Once section 20 is pivoted past ninety degrees, the opening snap action shown ensues. When the closing action is begun, snap action in closing occurs once the section is pivoted past the ninety degree position.

What is claimed is:

1. A plastic device adapted to engage and close the open neck of a container and comprising:

a vertical hollow cylinder open at its lower end;

a deck sealing the upper end of the cylinder, the deck having an opening communicating with the interior of the cylinder;

a cap for the upper end, the cap having essentially the same shape and area as the upper end, the cap consisting of a first relatively small section and a second relatively large section, the first section being secured along a portion of its periphery to a corresponding portion of the periphery of the upper end by an integral living hinge, the two sections having adjacent edges disposed along a curved line which extends across the deck, these edges being secured to each other at opposite ends of the line and being otherwise unsecured to each other, the secured edges at each end of the line each constituting a separate living hinge;

interconnecting means on said deck and said first section, spaced from all of the living hinges, securing the first section to said deck; and a prong secured to the second section and extending at right angles thereto, the prong being insertable into and removable out of the opening in the deck.

2. The device of claim 2 wherein the first section has an outer edge overlying a portion of the periphery of the top end and the second section has an outer edge overlying the remaining portion of the periphery of the top end.

3. The device of claim 2 wherein the means consists of a recess in the deck and a mating extension on the first section.

4. The device of claim 3 wherein the extension snap fits into the recess.

* * * * *